US006783851B2

(12) United States Patent
Crawford et al.

(10) Patent No.: US 6,783,851 B2
(45) Date of Patent: Aug. 31, 2004

(54) PITCH BASED GRAPHITE FABRICS AND NEEDLED PUNCHED FELTS FOR FUEL CELL GAS DIFFUSION LAYER SUBSTRATES AND HIGH THERMAL CONDUCTIVITY REINFORCED COMPOSITES

(75) Inventors: James Crawford, Rye, NH (US); Jean-Francois LeCostaouec, Hooksett, NH (US); Paul T. Kennedy, North Hampton, NH (US)

(73) Assignee: Albany International Techniweave, Inc., Rochester, NH (US)

( * ) Notice: Subject to any disclaimer, the term of this patent is extended or adjusted under 35 U.S.C. 154(b) by 70 days.

(21) Appl. No.: 10/213,968

(22) Filed: Aug. 7, 2002

(65) Prior Publication Data

US 2004/0028896 A1 Feb. 12, 2004

(51) Int. Cl.[7] ..... D01F 6/00
(52) U.S. Cl. ..... 428/364; 428/394
(58) Field of Search ..... 428/364, 394

(56) References Cited

U.S. PATENT DOCUMENTS

| | | | |
|---|---|---|---|
| 4,014,725 | A | 3/1977 | Schulz |
| 4,064,207 | A | 12/1977 | DeCrescente et al. |
| 4,080,778 | A | 3/1978 | Adams et al. |
| 4,115,528 | A | 9/1978 | Christner et al. |
| 4,138,525 | A | 2/1979 | Schulz |
| 4,837,117 | A | 6/1989 | Armiger et al. |
| 4,849,200 | A | 7/1989 | Uemura et al. |
| 4,863,708 | A | 9/1989 | Seo et al. |
| 4,915,926 | A | 4/1990 | Lahijani |
| 5,045,388 | A | 9/1991 | Bice et al. |
| 5,071,700 | A | 12/1991 | Sugino et al. |
| 5,205,888 | A | 4/1993 | Mochida et al. |
| 5,283,113 | A | 2/1994 | Nishimura et al. |
| 5,622,660 | A | 4/1997 | Uemura et al. |
| 6,027,786 | A | 2/2000 | Ford |

*Primary Examiner*—N. Edwards
(74) *Attorney, Agent, or Firm*—Frommer Lawrence & Haug

(57) ABSTRACT

A pitch precursor yarn, which is stretch broken and formed into a fabric or felt which is heat treated into graphitic fiber media for fuel cell gas diffusion layer substrates and high thermal conductivity reinforced composites.

34 Claims, 5 Drawing Sheets

PITCH BASED GRAPHITE FABRICS AND NEEDLED PUNCHED FELTS FOR FUEL CELL GAS DIFFUSION LAYER SUBSTRATES AND HIGH THERMAL CONDUCTIVITY REINFORCED COMPOSITES

FIELD OF THE INVENTION

The present invention is directed towards pitch based graphite fabric or felts made from stretch broken pitch precursor yarns for use in fuel cell. gas diffusion layer substrates and high thermal conductivity reinforced composites and the like.

BACKGROUND OF THE INVENTION

The use of carbonaceous material in conjunction with electron collection is well known. The function of the carbon or graphite has primarily been that of an electrical current (a currency) collector. A number of carbonaceous fiber based substrates have been proposed for fabricating gas diffusion layers ("GDLs") in fuel cell and forming specialized reinforced plastic composites. In a first application, the carbon or graphite fibers are used to create a porous substrate exhibiting a good electrical conductivity. In a second application the fiber is used to provide high mechanical properties and if desired raise the thermal conductivity of the reinforced plastic. High in-plane and through-the-thickness thermal conductivity reinforced plastic mounting plates are desirable, for example, in electronic applications where a large amount of heat needs to be rapidly dissipated away from electronic components mounted on the plates.

Fuel cell GDLs have been fabricated from papers, felts and fabrics using a number of polyacrylonitrile ("PAN") derived fibers. Fuel cells and other electrochemical devices are typically built from an assembly of bipolar plates, a GDL, a catalyst layer and a membrane. Such a device is shown in FIG. 1. The gas diffusion layer is also referred as membrane electrode or electrode substrate.

The fibrous GDL substrate is generally coated on one side or both sides with a carbonaceous mixture, the mixture containing fine graphite powders and various conductive fillers. A catalyst may be deposited within the porosity or at the surface of the coating.

While the GDL substrate is frequently fabricated with a PAN based paper, PAN based woven fabric or needled felt can be used. It is believed that the latter forms provide better handling ability as they have higher tensile strength than a paper media. These characteristics are essential in carrying the fibrous support during the coating operations. Several references refer to the use of PAN fiber to fabricate the GDL media. In particular, PCT Publication No.: WO 01/04980 describes the use of a low cost PAN to fabricate various forms of GDL media. In applications involving fuel cells, it is desirable that the gas diffusion layer so formed be as thin as possible. Accordingly, the fabric used in such application should be thin and have a smooth surface.

Typically, in fuel cell design, the base fabric is created by spinning yarns from staple PAN filament that typically ranges in length from one to two inches. These yarns are then woven into a plain weave fabric. The woven fabric is then carbonized by a heat treatment process in a nitrogen atmosphere. The now carbonized fabric is subject to a further heat treatment (at a higher temperature) to graphitize it, also in a nitrogen atmosphere. The fabric is subsequently coated with a carbonaceous mixture on which a platinum based catalyst may be deposited. Some fuel cell stack fabricators elect to apply the catalyst on the membrane.

PAN based fibers are the lowest cost carbon or graphite fibers available on the market. However, PAN fibers exhibit fairly poor electrical and thermal properties when compared with pitch based carbon or graphite fibers. Pitch derived carbon or graphite fibers exhibit electrical conductivity four to six times greater than PAN derived fibers and are a better choice than PAN fibers in a fuel cell application where superior electro-conductivity is needed to enhance overall fuel cell performance. An object of the present invention is to overcome the drawbacks of the existing forms and high cost of pitch fibers. Pitch fibers are available in costly large tow yarns or in the form of chopped fibers. None of these forms are suitable for fabricating a thin flat fabric or needle felt. The smallest denier commercially available in pitch is a tow of 3850 denier, which would generate a heavy thick GDL layer. Another limitation of typical commercial pitch fiber is their high moduli which limits their forming ability. For example, it is impossible to needle punch a highly carbonized or graphitized pitch fiber. One approach to yield a suitable size yarn for weaving or a suitable web for needling a felt is to subject tows of pitch fiber in a thermoset state to a stretch breaking process.

Reinforced plastics used for heat dissipation can also benefit from the invention. In such applications, mounting plates supporting electronic components play a structural role and act as conduits to dissipate heat away from electronic components. Pitch fibers, in the form of unidirectional fiber lay-up, sheet molding compound, paper and fabrics, are already used in these applications. The textile forms derived from the invention will help provide the electronics industry with lower cost thin fabric or needled punch felt that exhibits high through-the-thickness thermal conductivity. Following graphitization of the thermoset pitch textile, plates or other geometries may be readily fabricated into a rigid component through densification with thermoset or thermoplastic polymers.

SUMMARY OF THE INVENTION

It is therefore a principal object of the invention to provide for the use of pitch precursor graphite fibers in unique forms in increased applications, including fuel cells and in high thermal conductivity reinforced composites.

It is a further object of the invention to provide for the use of pitch precursor graphite fibers in unique forms, which may be woven into relatively thin fabrics or needle punched in thin mats.

It is a yet further object of the invention to provide for such fiber forms which are relatively inexpensive.

A further object of the invention is to provide for a fabric or a mat made from pitch precursor graphite fiber in unique forms having superior thermal and electrical conductivity.

A further object of the invention is to provide for a fabric or a mat made from a blend of pitch precursor graphite fiber in unique forms and PAN based graphite fiber.

These and other objects and advantages are provided by the present invention. In this regard the present invention takes pitch precursor yarn at the thermoset stage, which is prior to carbonization or graphitization. This yarn is relatively thick, i.e. 3850 denier or more. The yarn is then stretch broken by stretch breaking. Stretch breaking involves a process that starts with higher denier yarns and reduces them to lower denier yarns whereby the multiple filaments within the yarn bundle, are randomly broken and then drawn to a lower denier. These are then recombined in a durable yarn or in the form of a web also called a ribbon. The yarn is then woven or otherwise formed into a thin fabric, which is subject to heat treatments to convert the yarns into highly graphite yarns. Alternatively, the web can be stacked to a given thickness and at the desirable fiber orientation and needle punched. These yarns have the same relative properties that are obtained by the more expensive process of heat treating yarns and then forming a fabric therefrom. The fabric or the mat can be used in a fuel cell by impregnating or coating it with an appropriate carbonaceous mixture or used to fabricate high thermal conductivity reinforced plastic composites.

BRIEF DESCRIPTION OF THE DRAWINGS

Thus by the present invention its objects and advantages will be realized the description of which should be taken in conjunction with the drawings, wherein.

DETAILED DESCRIPTION OF THE PREFERRED EMBODIMENT

In this regard, the present invention is directed toward taking higher denier pitch precursor fiber tows and stretch breaking them into smaller denier yarn form or a ribbon form. The fiber retains the desired characteristics but is easier to process into thin fabrics for use in applications such as fuel cells where thin fabric or thin mat reinforcements are desirable.

Accordingly, there exists many methods and apparatus for achieving stretch breaking of yarns or filaments. An example of such an apparatus is that set forth in U.S. Pat. No. 5,045,388, the disclosure of which is incorporated herein by reference. While the particular apparatus used is not part of the present invention, a brief description of a typical apparatus is in order. In this regard, FIG. 2 is a schematic representation of the apparatus disclosed in the immediate aforementioned patent.

Figure 1:
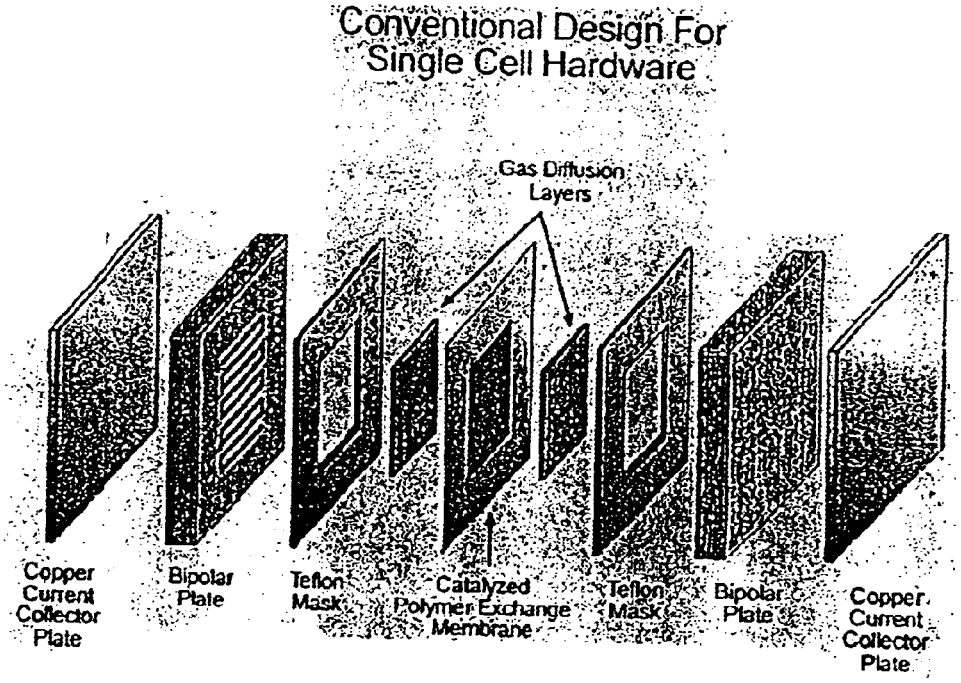
FIG. 1 shows a fuel cell featuring a gas diffusion layer.
Figure 2:
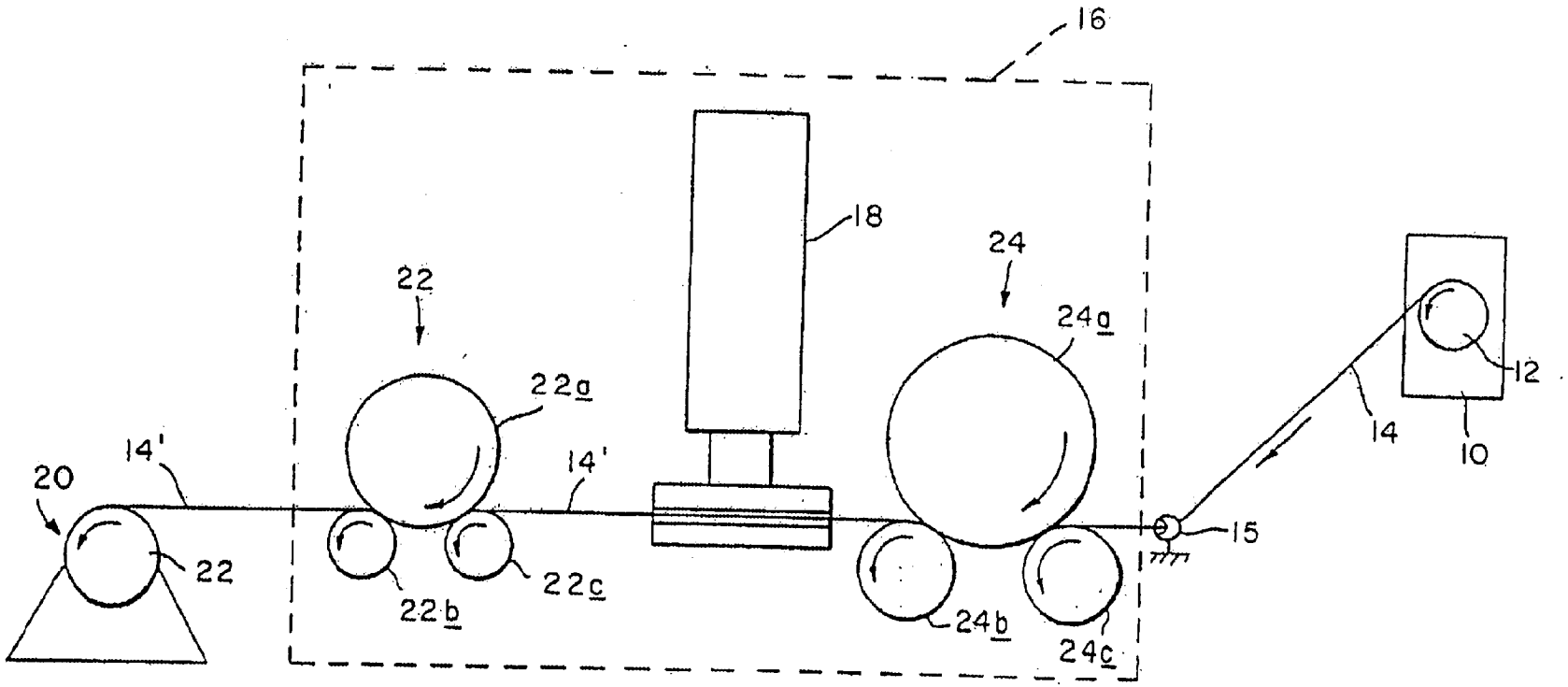
FIG. 2 shows a representative stretch breaking apparatus.
Figure 3:
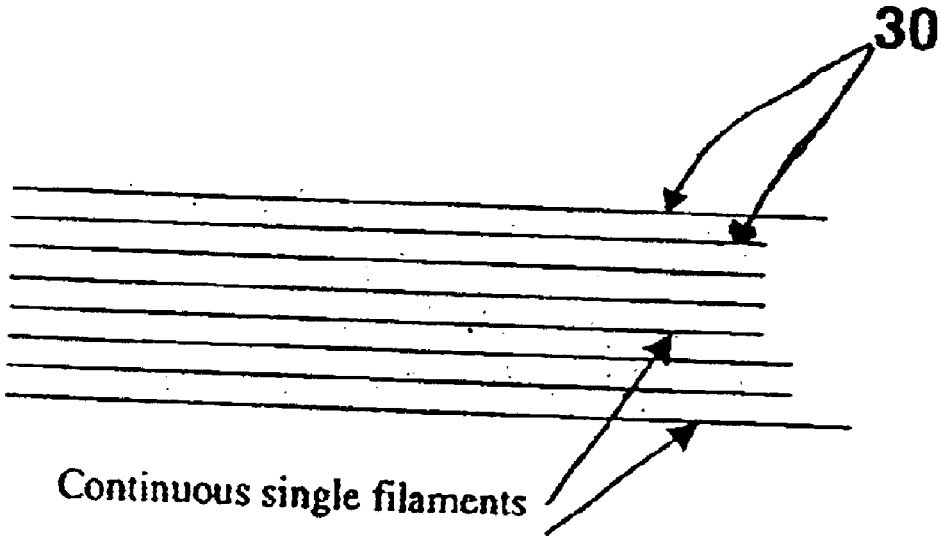
FIG. 3 shows a cross section of the yarn prior to stretch breaking.
Figure 4:
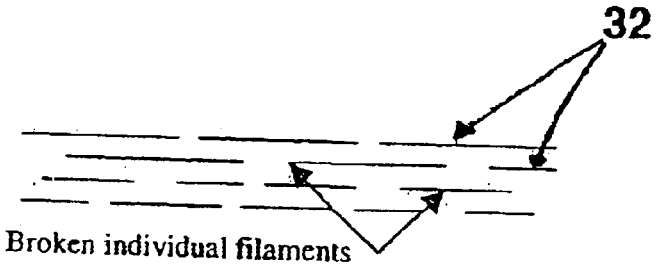
FIG. 4 shows a cross section of the yarn after stretch breaking.
Figure 5:
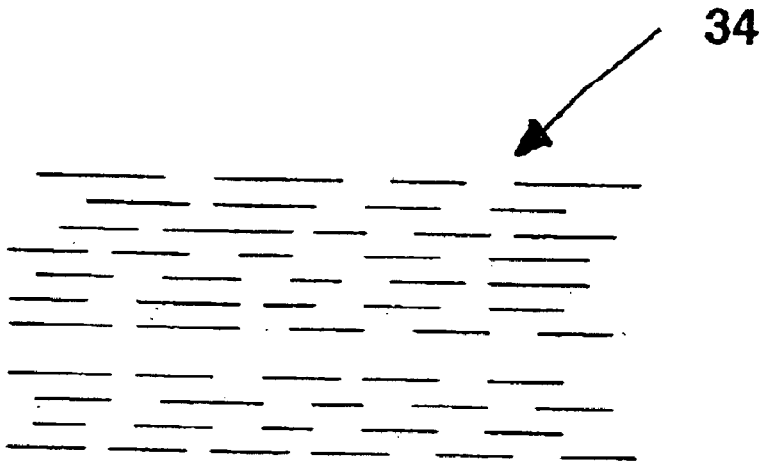
FIG. 5 shows a stretch broken web or ribbon.

The apparatus of FIG. 2 generally includes a creel 10 holding a rotatable bobbin 12 of a tow 14 of continuous filament fibers, a stretch breaking machine 16 with an integral hot air treater 18 and a windup 20 for winding a package 22. The stretch breaking machine 16 includes two breaker block units 22, 24. Unit 22 consists of driven roll 22*a* engaging and forming successive nips with ceramic coated metal rolls 22*b* and 22*c* which are water cooled. Roll 22*a* is covered with elastomer. In a similar arrangement, driven elastomer covered roll 24*a* engages and forms nips with ceramic coated metal rolls 24*b* and 24*c*. Roll 24*a* is covered with elastomer.

In operation the continuous filament fiber tow 14 is drawn from package 12 on creel 10 through guide 15 by means of driven roll 22*a* and associated nip rolls 22*b* and 22*c*. Roll 22*a* is driven at a higher speed (about 10 percent faster) than roll 24*a* to tension the tow. The conversion of the tow 14 into stretch broken aligned fiber tow 14' occurs between rolls 22*a* and 24*a*. The tow 14 passes between the nips formed between rolls 24*a*, 24*b* and 24*c*, which grip the tow. Since in this application the tow is reinforced with resin, the tow is then pulled through heater 18, which softens the resin by raising its temperature to about its melting point. Since the speed of roll 22*a* is faster than roll 24*a*, a tension is created in the tow between the rolls which is sufficient to break each of the continuous filaments in the tow between rolls 22*a* and 24*a*. Because the resin is soft the filaments do not transfer the shear load through the resin to adjacent filaments and because no shear load is transferred, the continuous filaments break randomly instead of all in one location. This random break distribution allows the tow 14' to remain continuous without separating. The resin cools rapidly after leaving heater 18 and is rapidly cooled when moved over water cooled rolls 22*b* and 22*c* which are at a temperature of about 50° F. The stretch broken tow is then wound into package 22 on winder 20 for further processing.

Other examples of stretch breaking includes that set forth in U.S. Pat. No. 4,080,778 and that described in U.S. Pat. No. 4,837,117. It should be noted that some stretch breaking equipment runs dry, without a resin.

Turning now more particularly to that to which the present invention is directed, as aforesaid, for fuel cells and similar applications, graphite materials in the form of either wovens or non-wovens are used as a substrate onto which catalyst containing coatings are applied. There are numerous attributes that the ideal graphite material will possess. Amongst these are in-plane and thru-thickness electrical and thermal conductivity. Fabrics are preferred over paper by many users because the fabrics are more durable and easier to handle through the coating processes that are required. Papers are smoother than "standard" fabrics and hold promise for lower production costs. Fabrics or mats should, however, be as thin as possible and have smooth surfaces.

The baseline fabric that is used by many in this field is manufactured by way of a multi-step process. The weaving yarns are spun from staple polyacrylonitrile (PAN) filaments that typically range in length from one to two inches. These yarns are woven into a plain weave fabric. The fabric is then subjected to a carbonization heat treatment process that is conducted in a nitrogen atmosphere. The resulting "carbon" fabric is then subjected to a graphitization process, which heat treats the material to yet a higher temperature. This is also conducted in a nitrogen atmosphere. The resulting properties of the graphite fabric are less than ideal but acceptable performance can be achieved with proper fuel cell design.

For thermal management applications, graphite fiber is combined with thermoset and/or thermoplastic polymers to yield high thermal conductivity composites.

Graphite fibers using a petroleum pitch precursor instead of a PAN precursor is preferred, since pitch precursor graphite fibers have superior mechanical, thermal and electrical performance compared to PAN based graphite fibers. However, the cost of such fibers precludes their use in many applications. In addition, the smallest pitch precursor yarn currently available are approximately 3850 denier and therefore only relatively thick fabrics can be woven from them. The present approach is to obtain pitch precursor yarn 30 at an intermediate stage in its processing, i.e. at the thermoset stage, prior to carbonization or graphitization. The yarn 30 is then stretch broken by any means suitable for the purpose. (Stretch breaking, as aforesaid, is a process that starts with high denier yarns and reduces them to low denier yarns 32 by a process whereby the multiple filaments within the yarn bundle are randomly broken and drawn to a lower denier.) Following stretch breaking, the resulting intermediate product, which is in the form of a ribbon 34, can be processed in a number of ways, including being held by a serving yarn after being stretch broken and spun to yield various textile products.

The ribbon 34 can be further reduced and is formed in a small yarn of an equivalent filaments count between 200 and 500. For example, the original tow may be reduced to approximately 500 denier, a reduction of approximately 8:1. This low denier yarn is then woven into a thin, smooth surface fabric and then subjected to two consecutive heat treatment processes. Alternatively, the yarn can be knitted or braided. The heat treatments convert the pitch precursor (thermoset stage yarn) into highly graphitic yarns with the same relative properties that are derived by the more expensive process of heat treating yarns and then weaving fabric from them.

Furthermore, the ribbon 34 can be directly formed into a stitch bonded multiaxial fabric. In addition, several layers of ribbons 34 can be mechanically secured by needle punching to fabricate a felt.

The resulting textile products offer electrical and thermal performance approximately six times greater than the standard PAN based fabrics. It can also be made thinner and be less costly thereby allowing a wider range of applications. The following table summarizes the desired and expected performance of the various options discussed.

| FEATURE | DESIRED ATTRIBUTE | PITCH PRE-CURSOR (PRIOR ART) | PAN PRE-CURSOR (BASELINE) | PITCH PRE-CURSOR |
|---|---|---|---|---|
| Filaments | Either continuous or discontinuous | Continuous | Dis-continuous | Dis-continuous |
| Yarn Denier | Low | High | High | Low |
| Fabric Thickness | Thin | Thick | Medium | Thin |
| Conductivity | High | High | Low | High |
| Price | Low | High | Low | Low |
| Durability | High | High | High | High |

Alternatively a blend of thermoset pitch and PAN fibers to create a hybrid yarn may be fed to the stretch breaking apparatus. An intimate mixture of both fiber types may be accomplished within the equipment. The resulting yarn or web has a higher electrical and thermal conductivity than the prior art using only PAN fiber.

The same textile products could be included in a thermoplastic or thermoset resin system to fabricate high thermal conductivity composites.

Thus by the present invention, its objects and advantages have been realized, and although preferred embodiments have been disclosed and described herein, its scope should not be limited thereby; rather its scope should be determined by that of the appended claims.

What is claimed is:

1. A yarn comprised of a pitch precursor material which has been stretch broken from a first filament count and drawn to a second filament count, with the second filament count being less than the first filament count.

2. The invention in accordance with claim 1 wherein said yarn is twisted after being stretch broken and spun.

3. The invention in accordance with claim 2 wherein the ratio of the first filament count to the second filament count is between 5 and 20.

4. The invention in accordance with claim 1 wherein said yarn is held with a serving yarn after being stretch broken and spun.

5. The invention in accordance with claim 4 wherein the ratio of the first filament count to the second filament count is between 5 and 20.

6. The invention in accordance with claim 1 wherein the ratio of the first filament count to the second filament count is between 5 and 20.

7. The invention in accordance with claim 1 wherein said yarn is woven into a fabric.

8. The invention in accordance with claim 1 wherein said yarn is stitch bonded into a multiaxial fabric.

9. The invention in accordance with claim 1 wherein said yarn is in layers and mechanically secured together by needle punching into a felt.

10. The invention in accordance with claim 7 wherein said fabric is subject to heat so as to convert the yarn of pitch precursor material into graphitic yarn.

11. The invention in accordance with claim 8 wherein said fabric is subject to heat so as to convert the yarn of pitch precursor material into graphitic yarn.

12. The invention in accordance with claim 9 wherein said felt is subject to heat so as to convert the yarn of pitch precursor material into graphitic fibers.

13. The invention in accordance with claim 10 wherein said fabric is coated with a carbonaceous mixture.

14. The invention in accordance with claim 11 wherein said fabric is coated with a carbonaceous mixture.

15. The invention in accordance with claim 12 wherein said felt is coated with a carbonaceous mixture.

16. The invention in accordance with claim 10 wherein said fabric is incorporated in a composite comprising a thermoplastic or thermoset resin.

17. The invention in accordance with claim 11 wherein said fabric is incorporated in a composite comprising a thermoplastic or thermoset resin.

18. The invention in accordance with claim 12 wherein said felt is incorporated in a composite comprising a thermoplastic or thermoset resin.

19. A hybrid yarn comprised of pitch precursor fibers and PAN fibers which has been stretch broken from a first filament count to a second filament count, with the second filament count being less than the first filament count.

20. The invention in accordance with claim 19 wherein said yarn is twisted after being stretch broken and spun.

21. The invention in accordance with claim 19 wherein said yarn is held with a serving yarn after being stretch broken and spun.

22. The invention in accordance with claim 19 wherein the ratio of the first filament count to the second filament count to between 5 and 20.

23. The invention in accordance with claim 19 wherein said yarn is woven into a fabric.

24. The invention in accordance with claim 19 wherein said yarn is stitch bonded into a multiaxial fabric.

25. The invention in accordance with claim 19 wherein said yarn is in layers and mechanically secured together by needle punching into a felt.

26. The invention in accordance with claim 23 wherein said fabric is subject to heat so as to convert the yarn of pitch precursor material into graphitic yarn.

27. The invention in accordance with claim 24 wherein said fabric is subject to heat so as to convert the yarn of pitch precursor material into graphitic yarn.

28. The invention in accordance with claim 25 wherein said felt is subject to heat so as to convert the yarn of pitch precursor material into graphitic fibers.

29. The invention in accordance with claim 26 wherein said fabric is coated with a carbonaceous mixture.

30. The invention in accordance with claim 27 wherein said fabric is coated with a carbonaceous mixture.

31. The invention in accordance with claim 28 wherein said felt is coated with a carbonaceous mixture.

32. The invention in accordance with claim 26 wherein said fabric is incorporated in a composite comprising a thermoplastic or thermoset resin.

33. The invention in accordance with claim 27 wherein said fabric is incorporated in a composite comprising a thermoplastic or thermoset resin.

34. The invention in accordance with claim 28 wherein said felt is incorporated in a composite comprising a thermoplastic or thermoset resin.

* * * * *